US007304557B2

(12) United States Patent
Tsuzuki et al.

(10) Patent No.: US 7,304,557 B2
(45) Date of Patent: Dec. 4, 2007

(54) LAMINATED COIL

(75) Inventors: Keiichi Tsuzuki, Higashiomi (JP); Tatsuya Mizuno, Omihachiman (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 0 days.

(21) Appl. No.: 10/597,014

(22) PCT Filed: May 31, 2005

(86) PCT No.: PCT/JP2005/009975

§ 371 (c)(1),
(2), (4) Date: Jul. 6, 2006

(87) PCT Pub. No.: WO2005/122192

PCT Pub. Date: Dec. 22, 2005

(65) Prior Publication Data

US 2007/0182519 A1 Aug. 9, 2007

(30) Foreign Application Priority Data

Jun. 7, 2004 (JP) ..... 2004-168569

(51) Int. Cl.
*H01F 5/00* (2006.01)

(52) U.S. Cl. ..... 336/200; 336/223; 336/232

(58) Field of Classification Search ..... 336/200, 336/223, 232
See application file for complete search history.

(56) References Cited

U.S. PATENT DOCUMENTS 5,170,302 A * 12/1992 Matsumoto ..... 360/123
6,459,351 B1 10/2002 Maki et al.
6,515,568 B1 2/2003 Maki et al.
6,710,694 B2 * 3/2004 Matsuta et al. ..... 336/200
2002/0140539 A1 * 10/2002 Takashima et al. ..... 336/200
2002/0157849 A1 10/2002 Sakata

FOREIGN PATENT DOCUMENTS

JP 62189707 A * 8/1987
JP 08-097038 A 4/1996
JP 8-124746 A 5/1996
JP 2000-182834 A 6/2000
JP 2001-044036 A 2/2001
JP 2001-044037 A 2/2001
JP 2002-246231 A 8/2002
JP 2003-092214 A 3/2003

OTHER PUBLICATIONS

International Search Report issued in the corresponding International Application No. PCT/JP2005/009975, mailed on Sep. 20, 2005.

Official communication issued in the counterpart European Application No. 05 745 687.3, mailed on Apr. 25, 2007.

Official communication issued in the counterpart European Application No. 05745687.3, mailed on Feb. 6, 2007.

* cited by examiner

*Primary Examiner*—Anh Mai
(74) *Attorney, Agent, or Firm*—Keating & Bennett, LLP

(57) ABSTRACT

A laminated coil includes a non-magnetic body section (5) inside a laminated body. On the non-magnetic body section (5), a coil conductor (4*c*) is provided. The coil number of the coil conductor (4*c*) is greater than the coil number of a coil conductor (4*d*) that is a coil conductor other the coil conductor (4*c*) on the non-magnetic body section (5).

17 Claims, 8 Drawing Sheets

LAMINATED COIL

BACKGROUND OF THE INVENTION

1. Field of the Invention

The present invention relates to a laminated coil and, more specifically, to a laminated coil having an excellent direct current (DC) superimposition characteristic.

2. Description of the Related Art

A laminated coil is produced by stacking magnetic sheets each composed of ferrite or other suitable magnetic material and provided with a coil conductor composed primarily of Ag. Such a laminated coil is used in various circuits. In the laminated coil, the effective magnetic permeability is increased and a high inductance value is obtained because a closed magnetic path is produced by the magnetic field that is generated by an electrical current flowing through the coil conductors. The laminated coil is also advantageous in that loss caused by the conductor resistance is small because the conductor patterns are primarily composed of Ag. Thus, the laminated coil is used as a choke coil for a switching power supply to which a high current is applied.

For coil elements, the relationship between the current value applied to the coil conductors and the inductance value is represented as a DC superimposition characteristic. For a laminated coil having a closed magnetic path, there is a problem in that the desired choke coil characteristic cannot be obtained because the inductance value quickly decreases when the current exceeds a predetermined value. This degradation of the DC superimposition characteristic is caused by magnetic saturation in the magnetic body generated because the laminated coil produces a closed magnetic path.

To solve the above-identified problem, the laminated coil described in Japanese Unexamined Patent Application Publication No. 2001-44036 includes non-magnetic body layers that are provided inside the laminated coil composed of ferromagnetic layers. With the structure described in Japanese Unexamined Patent Application Publication No. 2001-44036, a closed magnetic path is less likely to be produced inside the magnetic body because the magnetic flux from the non-magnetic body layers leak outside the laminated coil. Thus, magnetic saturation is not likely to occur, and the DC superimposition characteristic is improved.

However, according to the structure of Japanese Unexamined Patent Application Publication No. 2001-44036, the amount of magnetic flux that leaks from the non-magnetic body layers is limited because the coil conductors provided on the non-magnetic body layers and the coil conductors provided on the ferromagnetic layers have the same shape and the same number of coil turns. Therefore, when the value of the electric current flowing through the coil conductors is increased, the DC superimposition characteristic is likely to deteriorate.

SUMMARY OF THE INVENTION

To overcome the problems described above, preferred embodiments of the present invention provide a laminated coil having an excellent DC superposition characteristic in which magnetic saturation is less likely to occur inside the laminated coil, and the inductance value does not change even when a high electric current is applied.

The laminated coil according to a preferred embodiment of the present invention includes a laminated body having magnetic body sections disposed on both main surfaces of a non-magnetic body section, each of the magnetic body sections including a plurality of stacked magnetic layers, the non-magnetic body section including a plurality of stacked non-magnetic layers, and a coil including coil conductors provided on the magnetic body sections and the non-magnetic body section, the coil conductors being helically connected. The number of coil turns of the coil conductors provided on the non-magnetic body section is greater than the number of coil turns of the coil conductors provided on each layer other than the coil conductors provided on the non-magnetic body section.

As described above, the number of coil turns of the coil conductors provided on the non-magnetic body section is greater than the number of coil turns of the coil conductors provided on the other layers. Thus, the amount of magnetic flux leaking from the non-magnetic body sections is increased. Accordingly, a laminated coil having an excellent DC superposition characteristic in which the inductance value is not reduced even when a high electric current is applied to the coil conductors is obtained.

The coil conductors are preferably provided on the non-magnetic body section are disposed on a main surface of the non-magnetic body section.

The amount of magnetic flux leaking from the non-magnetic body section is increased by setting the number of coil turns of the coil conductors provided on a main surface of the non-magnetic body sections greater than the number of coil turns of the other coil conductors. Accordingly, a laminated coil having an excellent DC superposition characteristic in which the inductance value is not reduced even when a high electric current is applied to the coil conductors is obtained.

The coil conductors provided on the non-magnetic body section are preferably disposed on both main surfaces of the non-magnetic body section.

The amount of magnetic flux leaking from the non-magnetic body section is increased by setting the number of coil turns of the coil conductors provided on both main surfaces of the non-magnetic body sections greater than the number of coil turns of the other coil conductors. Accordingly, the DC superposition characteristic of the laminated coil is further improved.

According to another preferred embodiment of the present invention, the coil conductors provided on the non-magnetic body section are provided inside the non-magnetic body section.

With this structure, the strength of the magnetic field generated in the vicinity of the non-magnetic body section is increased and the amount of magnetic flux leaking from the non-magnetic body section to the outside of the laminated coil is increased. Accordingly, the DC superposition characteristic of the laminated coil is further improved.

According to another preferred embodiment of the present invention, the coil conductors provided on the non-magnetic body section are provided on a main surface of the non-magnetic body section and inside the non-magnetic body section.

The number of coil turns of the coil conductors provided on the non-magnetic body section is preferably greater than the number of coil turns of the other coil conductors, and there are also coil conductors provided inside the non-magnetic body section.

With this structure, the strength of the magnetic field generated in the vicinity of the non-magnetic body section is increased and the amount of magnetic flux leaking from the non-magnetic body section to the outside of the laminated coil is increased. Accordingly, the DC superposition characteristic of the laminated coil is further improved.

According to another preferred embodiment of the present invention, a plurality of the non-magnetic body sections is provided inside the laminated body.

Thus, the amount of magnetic flux leaking from the non-magnetic body section to the outside of the laminated coil is increased, and the DC superposition characteristic of the laminated coil is improved.

The laminated coil according to preferred embodiments of the present invention includes a laminated body having magnetic body sections disposed on both main surfaces of a non-magnetic body section, each of the magnetic body sections including a plurality of stacked magnetic layers, the non-magnetic body section including a plurality of stacked non-magnetic layers, and a coil including coil conductors provided on the magnetic body sections and the non-magnetic body section, the coil conductors being helically connected. Moreover, the number of coil turns of the coil conductors provided on the non-magnetic body section is greater than the number of coil turns of the coil conductors provided on each layer, other than the coil conductors provided on the non-magnetic body section.

Thus, the amount of magnetic flux leaking from the non-magnetic body section to the outside of the laminated coil is increased. In this way, a laminated coil having an excellent DC superposition characteristic in which the inductance value does not deteriorate even when a high electric current is applied is obtained. Accordingly, the characteristics of the laminated coil as a choke coil are greatly improved.

Other features, elements, steps, characteristics and advantages of the present invention will become more apparent from the following detailed description of preferred embodiments of the present invention with reference to the attached drawings.

DETAILED DESCRIPTION OF PREFERRED EMBODIMENTS

Preferred embodiments of the present invention will be described below with reference to the attached drawings.

First Preferred Embodiment

Figure 1:
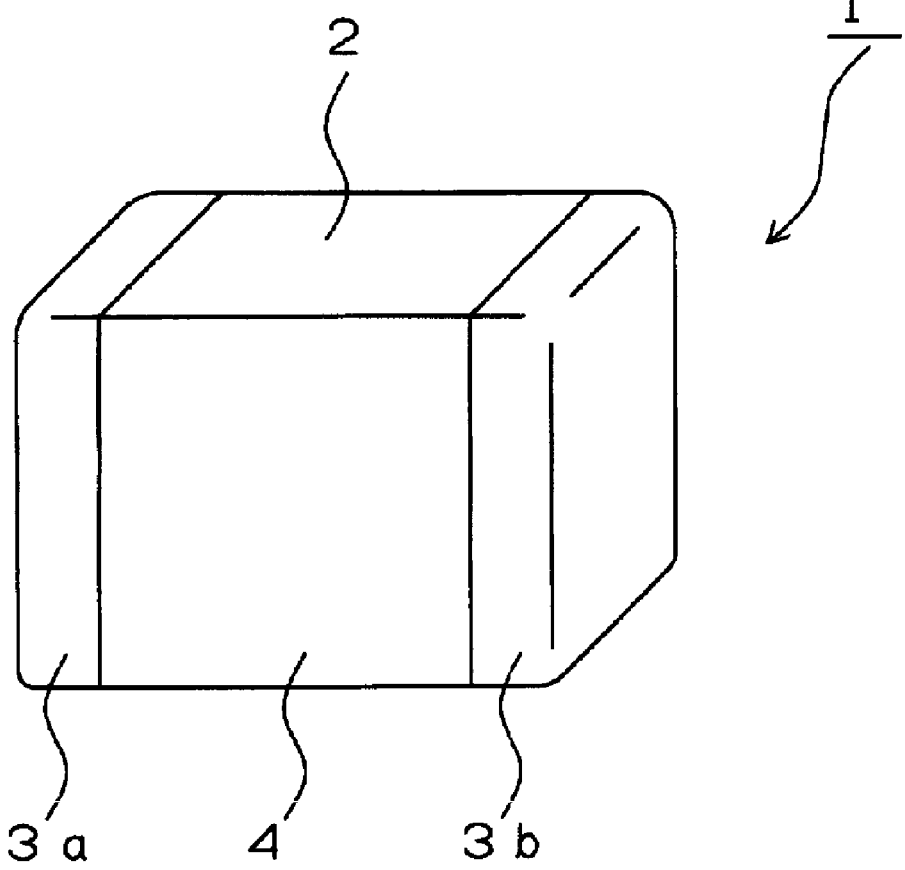
FIG. 1 is an external schematic view of a laminated coil according to a first preferred embodiment of the present invention.
Figure 2:
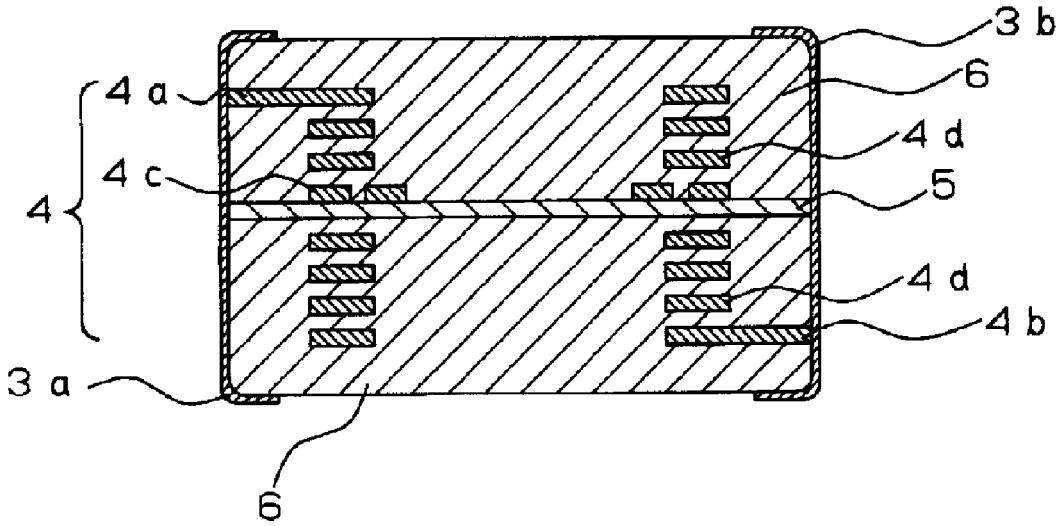
FIG. 2 is schematic cross-sectional view of a laminated coil according to the first preferred embodiment of the present invention.

FIG. 1 is an external perspective view of a laminated coil according to a first preferred embodiment of the present invention. FIG. 2 is a schematic cross-sectional view of the laminated coil. A laminated coil 1 includes a laminated body 2, external electrodes 3*a* and 3*b* provided on the surface of the laminated body 2 and coil conductors 4 embedded in the laminated body 2. The laminated body 2 is configured such that magnetic body sections 6 formed by stacking magnetic layers is disposed on both main surfaces of a non-magnetic body section 5. Inside the laminated body 2, the coil conductors 4 are embedded so as to form one helical coil whose axial direction is the lamination direction.

The non-magnetic body section 5 and the magnetic body sections 6 are each defined by at least one green sheet composed of non-magnetic material or magnetic material. A first end portion 4*a* of the coil conductors 4 is connected to the external electrode 3*a* and a second end portion 4*b* is connected to the external electrode 3*b*. A coil conductor 4*c* is provided on the non-magnetic body section 5. The number of coil turns of the coil conductor 4*c* is greater than that of other coil conductors 4*d* provided on the green sheets being composed of magnetic material and defining the magnetic body sections 6.

Next, a method of producing the laminated coil 1 will be described with reference to an exploded perspective view of the laminated coil 1 shown in FIG. 3. First, a method of producing green sheets to be stacked using magnetic material and non-magnetic material will be described.

In this preferred embodiment, a Cu—Zn based material is used as a non-magnetic material. First, a raw material including about 48 mol % of ferric oxide ($Fe_2O_3$), about 43 mol % of zinc oxide (ZnO), and about 9 mol % of copper oxide (CuO) is wet prepared by a ball mill for a predetermined amount of time. The obtained mixture is dried and ground. The obtained powder is calcinated at about 750° C. for about one hour. This ferrite powder is mixed with a binder resin, a plasticizer, a moistening agent, and a dispersant by a ball mill for a predetermined amount of time. Then, defoaming is performed by depressurization to obtain slurry. The slurry is applied onto a substrate of PET film. Then, by drying, a ferrite green sheet that has a predetermined thickness and that is made of a non-magnetic material is produced.

A Ni—Cu—Zn based material is used as a magnetic material. A material including about 48 mol % of $Fe_2O_3$, about 20 mol % of ZnO, about 9 mol % of CuO, and about 23 mol % of nickel oxide (NiO) is used as raw material to obtain slurry by the same method as the above-described method used for the non-magnetic material. The slurry is applied onto a substrate of PET film. Then, by drying, a ferrite green sheet that has a predetermined thickness and that is made of a magnetic material is produced.

The non-magnetic and magnetic ferrite green sheets produced as described above are cut into predetermined sizes to obtain ferrite sheet pieces. Then, through-holes are formed by a laser beam at predetermined locations on the ferrite green sheets such that the coil conductors 4*a*-4*c* on the sheets are connected with each other to form the coil conductor 4 when the above-described green sheets are stacked. The relative magnetic permeability of each ferrite green sheet is about 1 for the Cu—Zn based ferrite green sheet and about 130 for the Ni—Cu—Zn based ferrite green sheet.

Figure 3:
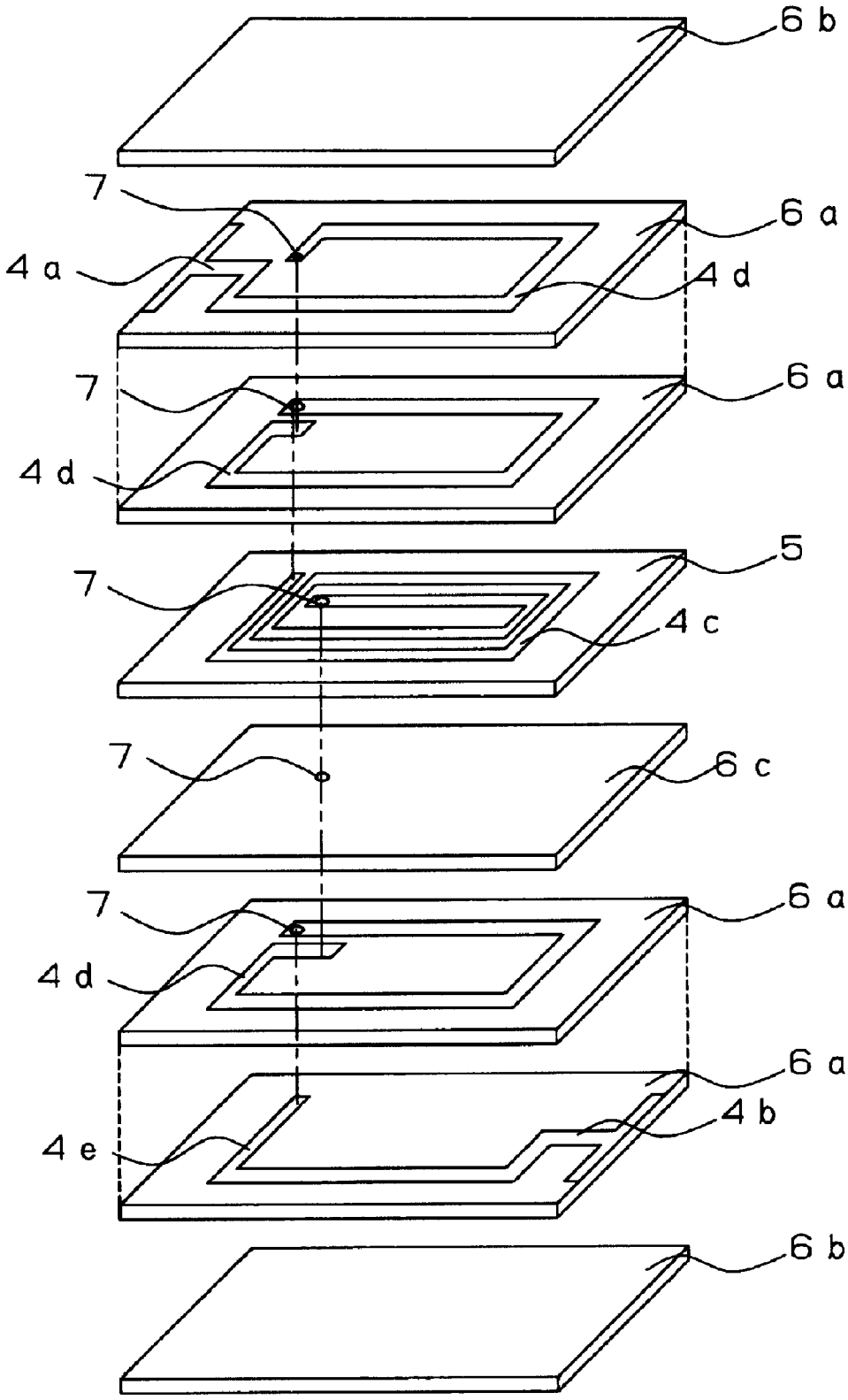
FIG. 3 is an exploded perspective view of a laminated coil according to the first preferred embodiment of the present invention.

Next, as illustrated in FIG. 3, a coil conductor having a predetermined shape is produced by applying a conductive paste primarily including Ag or an Ag alloy, such as Ag—Pd, by screen printing onto the ferrite green sheets on which coil conductors are formed. On a non-magnetic layer, the green sheet 5 composed of the Cu—Zn based material, the coil conductor 4*c* having two coil turns is formed. On a magnetic layer, the green sheet 6*a* composed of the Cu—Zn based material, the coil conductor 4*d* having one coil turn and a coil conductor 4*e* having a half coil turn are formed. Screen printing of the coil conductor is performed such that through-holes 7 are formed at the end portions of the coil conductors 4*c* and 4*d*. At the same time that the printing is performed, conductive paste is filled into the through-holes 7. The line width of the coil conductor 4*c* is less than that of the coil conductor 4*d*.

In a coil according to this preferred embodiment of the present invention, a magnetic field extending from the axial center to the outer periphery of the coil is generated. If the diameter of the cross-sectional opening of the helical electrode formed by connecting the coil conductors on the green sheets is reduced, the magnetic field that passes through the axial center of the coil is disturbed. Thus, a possible defect in electric characteristics, such as a reduction in the inductance value, may occur. To reduce the disturbance of the magnetic field, the line width of the coil conductors having a greater number of coil turns is reduced. In addition to the above-described green sheets, a Ni—Cu—Zn based green sheet 6*c* having only a through-hole 7 filled with conductive paste and Ni—Cu—Zn based green sheets 6*b* for the exterior are produced.

These green sheets are stacked in the order shown in FIG. 3 and are pressure bonded at about 45° C. at a pressure of about 1.0 t/cm$^2$. By cutting the obtained laminated body into 3.2×1.6×0.8 mm pieces using a dicing apparatus, unfired bodies of the laminated coil are obtained. Binder removal and firing of these unfired bodies are performed. The bodies are fired in a low oxygen atmosphere at about 500° C. for about 120 minutes for binder removal and are fired in an atmosphere of about 890° C. for about 150 minutes for firing. Finally, conductive paste primarily including Ag is applied by immersion to the end surfaces of the laminated coil where the lead electrodes 4*a* and 4*b* are exposed. A laminated coil is obtained after forming external terminals by drying the bodies at about 100° C. for about 10 minutes and then baking at about 780° C. for about 150 minutes.

As shown in FIG. 3, the laminated coil according to the first preferred embodiment has the non-magnetic body section 5 disposed substantially in the middle in the lamination direction. Since the relative magnetic permeability of the non-magnetic body section 5 is about one, or the same as that of air, the structure of the laminated coil will appear as though the laminated coil is divided into two by air. Thus, the magnetic field inside the laminated coil cannot generate a closed magnetic path from the axial center of the coil to the outer peripheral area of the coil conductors. Since the magnetic field inside the non-magnetic body section 5 has a uniform distribution similar to that of air, a magnetic field that leaks from the non-magnetic body section 5 to the outside of the laminated coil is generated without the magnetic field concentration as inside the magnetic body section 6. As a result, the magnetic saturation caused by concentration of the magnetic field inside the laminated coil is reduced.

According to this preferred embodiment, the number of coil turns of the coil conductor 4*c* on the non-magnetic body section 5 is greater than the number of coil turns of the coil conductor 4*d* on the magnetic layer 6*a*. Since the strength of the generated magnetic field is increased when the number of coil turns is increased, the magnetic field is concentrated to a greater extent on the coil conductor on the non-magnetic body section 5. Thus, the magnetic field leaking from the non-magnetic body section 5 is increased. Therefore, even when a high electrical current is applied to the coil conductors, magnetic saturation does not occur inside the laminated coil. Thus, the DC superimposition characteristic of the laminated coil is greatly improved.

According to this preferred embodiment, the non-magnetic body section 5 is defined by one Cu—Zn based ferrite green sheet. However, the non-magnetic body section 5 may be defined by a plurality of Cu—Zn based ferrite green sheets.

Second Preferred Embodiment

Figure 4:
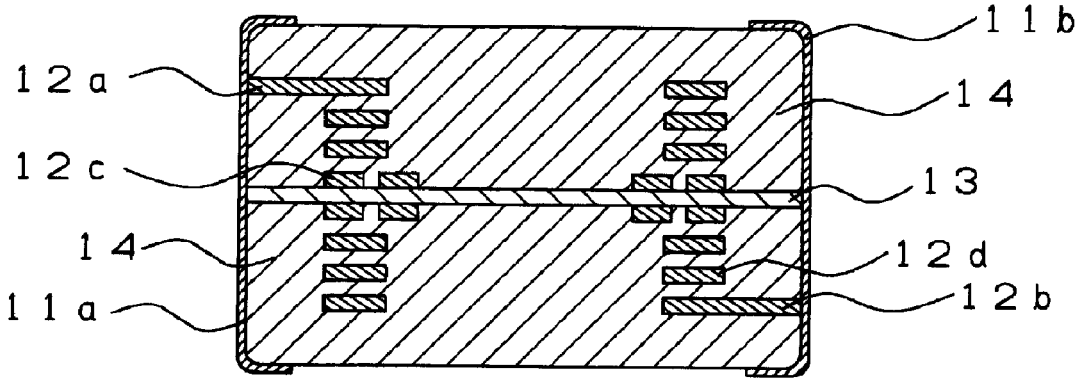
FIG. 4 is schematic cross-sectional view of a laminated coil according to a second preferred embodiment of the present invention.
Figure 5:
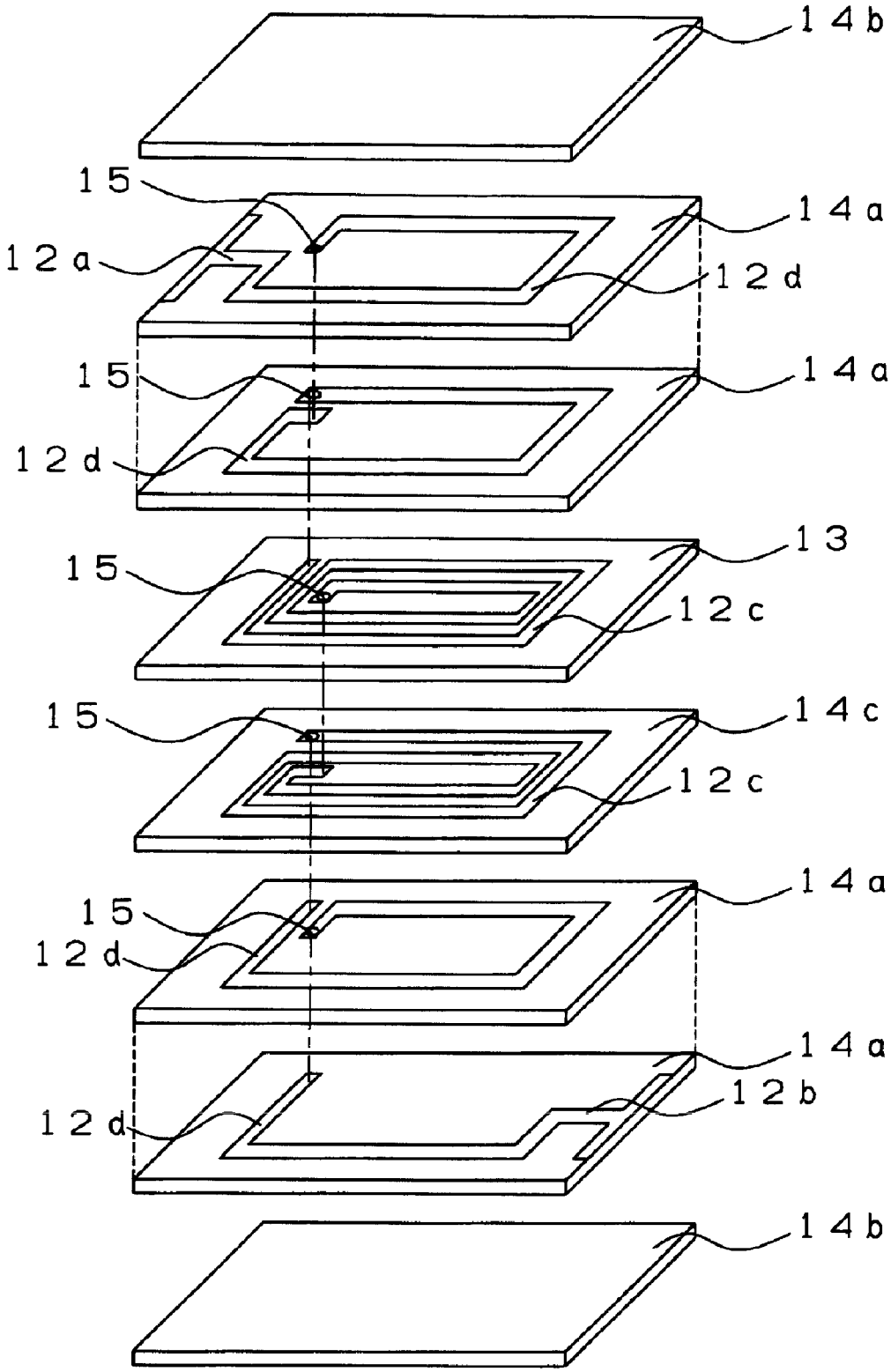
FIG. 5 is an exploded perspective view of a laminated coil according to the second preferred embodiment of the present invention.

FIGS. 4 and 5 illustrate a schematic sectional view and an exploded perspective view, respectively, of a laminated coil according to a second preferred embodiment of the present invention. According to this preferred embodiment, above and below a non-magnetic body section 13, coil conductors 12*c*, whose number of coil turns is greater than that of coil conductors 12*d* provided on a magnetic body section 14, are provided. The laminated coil according to this preferred embodiment, similar to the laminated coil according to the first preferred embodiment, is produced through the steps of stacking ferrite green sheets including coil conductors in the order shown in FIG. 5, pressure compressing, dicing the sheets into chips, and, then, forming external terminal electrodes.

As shown in FIG. 5, by increasing the number of coil turns of the coil conductors 12*c* that are provided above and below the non-magnetic body section 13, the magnetic field leaking outside the laminated coil is increased to a greater extent than that of the first preferred embodiment. Thus, the magnetic saturation of the magnetic body section 14 is further reduced. Accordingly, the DC superimposition characteristic of the laminated coil is further improved.

Third Preferred Embodiment

Figure 6:
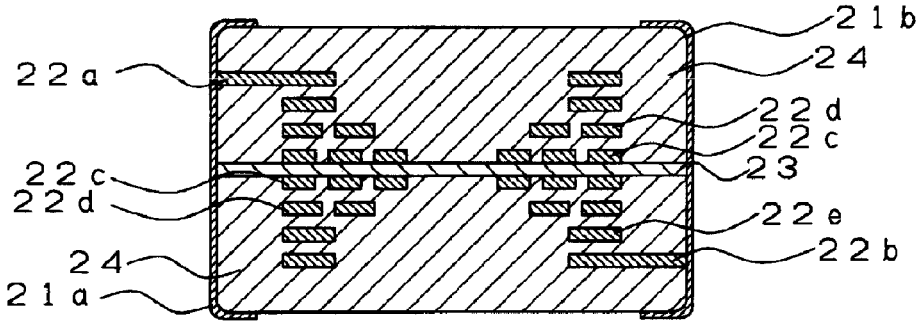
FIG. 6 is schematic cross-sectional view of a laminated coil according to a third preferred embodiment of the present invention.

FIG. 6 illustrates a schematic cross-sectional view of a laminated coil according to a third preferred embodiment of the present invention. According to this preferred embodiment, coil conductors 22*c* provided on and under a non-magnetic layer 23 each have three coil turns, and coil conductors 22*d* provided above and below the coil conductors 22*c* each have two coil turns. By using a laminated coil having a structure according to this preferred embodiment, the magnetic field is even more concentrated in the vicinity of the non-magnetic layer 23. Thus, the magnetic saturation inside the laminated coil is reduced, and the DC superimposition characteristic of the laminated coil is improved.

Figure 7:
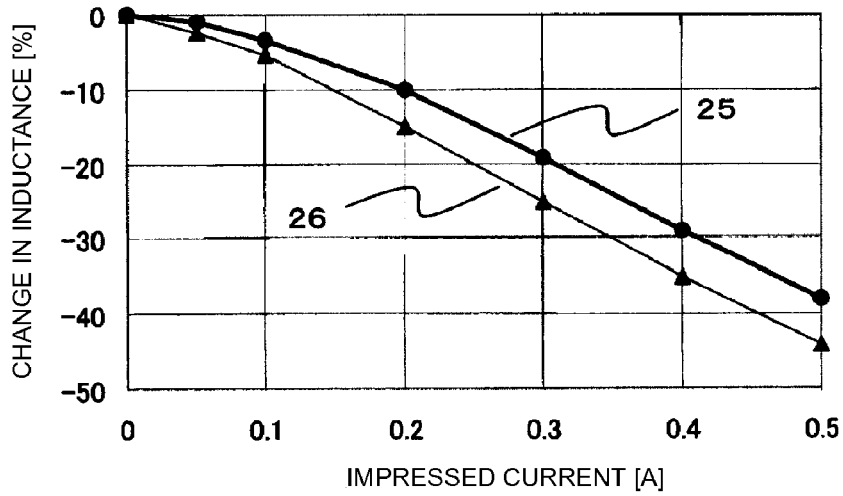
FIG. 7 is a graph representing a direct current superimposition characteristic of a laminated coil according to the third preferred embodiment of the present invention.

FIG. 7 illustrates the DC superimposition characteristic of the laminated coil according to this preferred embodiment. FIG. 7 illustrates a characteristic 25 for a configuration in which the number of coil turns of the coil conductors 22*c* and the coil conductors 22*d* is greater than that of another coil conductor 22*e* and a characteristic 26 for a known structure in which the number of coil turns is not changed. The inductance value of the laminated coil when the value of the electric current applied to the coil conductors is small is about 4.7 μH. The change in inductance represented by the vertical axis of the graph corresponds to a value obtained by dividing the reduction in the inductance value when the applied current is increased by the initial value, about 4.7 μH. As described in this preferred embodiment, by increasing the number of coil turns of the coil conductors provided on the non-magnetic layer and/or the vicinity thereof, the DC superimposition characteristic is improved, and particularly when the applied current is large.

Fourth Preferred Embodiment

Figure 8:
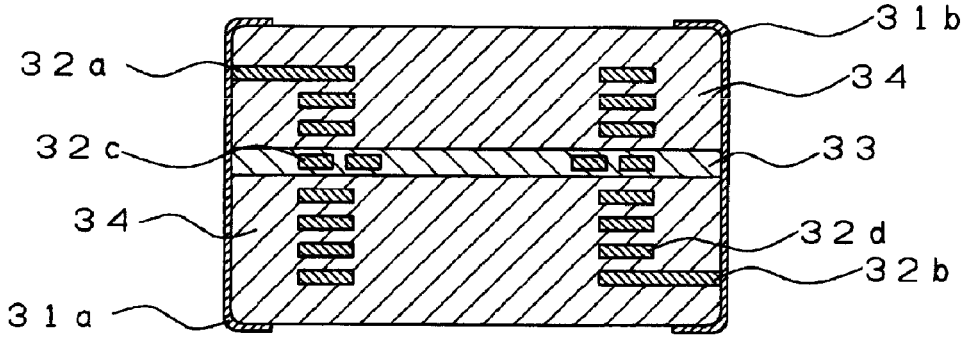
FIG. 8 is schematic cross-sectional view of a laminated coil according to a fourth preferred embodiment of the present invention.
Figure 9:
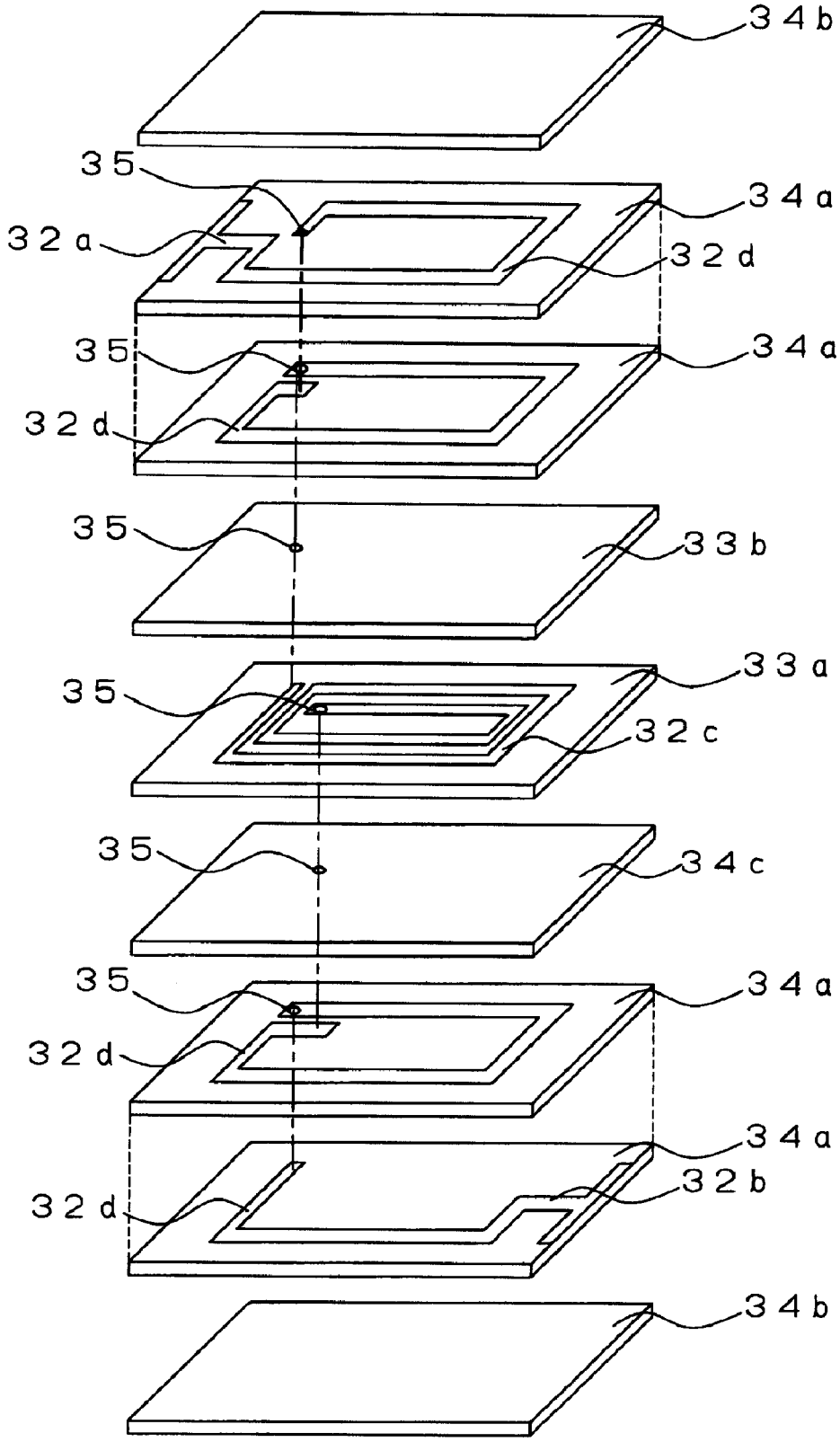
FIG. 9 is an exploded perspective view of a laminated coil according to the fourth preferred embodiment of the present invention.

FIG. 8 illustrates a schematic cross-sectional view of a laminated coil according to a fourth preferred embodiment. According to this preferred embodiment, a coil conductor 32*c* having the number of coil turns greater than that of a conductive pattern 32*d* provided on a magnetic body section 32 is formed inside a non-magnetic body section 33. FIG. 9 illustrates an exploded perspective view of the laminated coil according to this preferred embodiment. As shown in FIG. 9, to embed the coil conductor 32*c* inside the non-magnetic body section 33, the coil conductor 32*c* is formed on a non-magnetic layer 33*a*, and then a non-magnetic layer 33*b*, not including a coil conductor, is stacked on the non-magnetic layer 33*a*. By using a laminated coil having the structure according to this preferred embodiment, the magnetic field is concentrated inside the non-magnetic layer 33, and the leakage of magnetic field from the non-magnetic body section 33 to outside the laminated coil is increased. Therefore, magnetic saturation of the magnetic body sections is reduced, and the DC superimposition characteristic of the laminated coil is improved.

Fifth Preferred Embodiment

Figure 10:
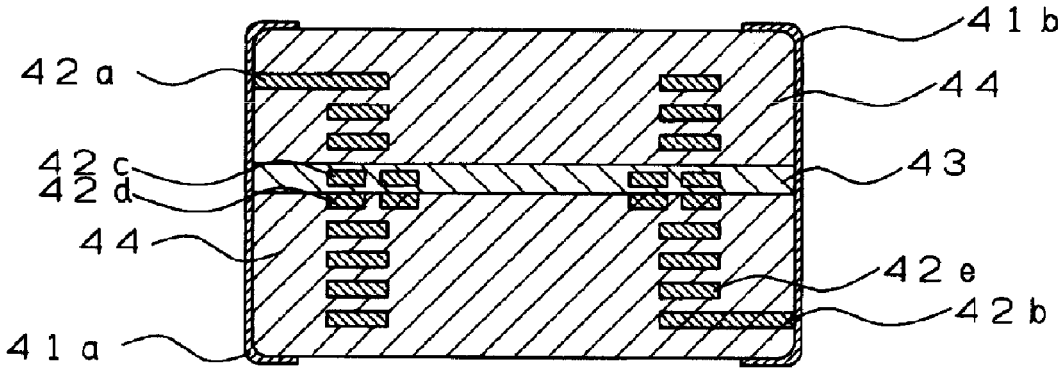
FIG. 10 is schematic cross-sectional view of a laminated coil according to a fifth preferred embodiment of the present invention.

FIG. 10 illustrates a schematic cross-sectional view of a laminated coil according to a fifth preferred embodiment of the present invention. According to this preferred embodiment, coil conductors 42*c* and 42*d* are formed inside a non-magnetic body section 43 and on the non-magnetic body section 43, respectively. Since coil conductors according to this preferred embodiment are provided inside and on the main surface of the non-magnetic body section 43, the magnetic field leaks even more from the non-magnetic body section 43 to the outside of the laminated coil. Thus, the effect of reducing magnetic saturation of the magnetic body section is increased, and the DC superimposition characteristic of the laminated coil is further improved.

The laminated coils according to the first to fifth preferred embodiments each include a non-magnetic body section in the middle in the lamination direction of the laminated coil. However, even if the non-magnetic body section is provided at a location other than the center, the DC superimposition characteristic of the laminated coil is improved.

Sixth Preferred Embodiment

Figure 11:
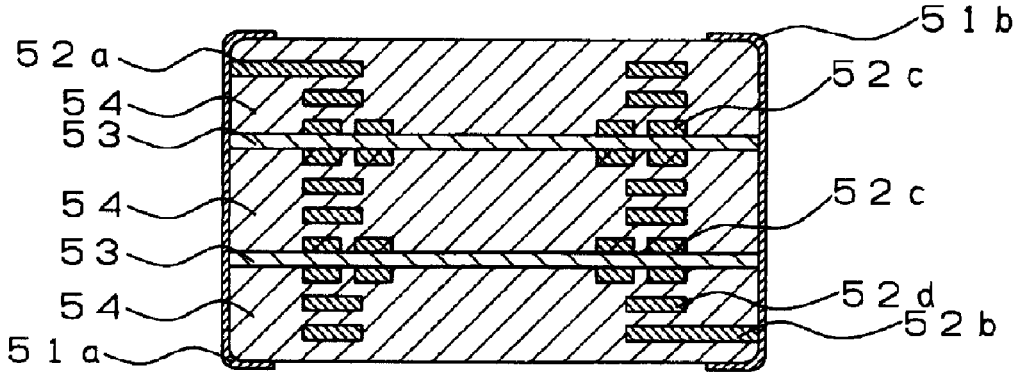
FIG. 11 is schematic cross-sectional view of a laminated coil according to a sixth preferred embodiment of the present invention.
Figure 12:
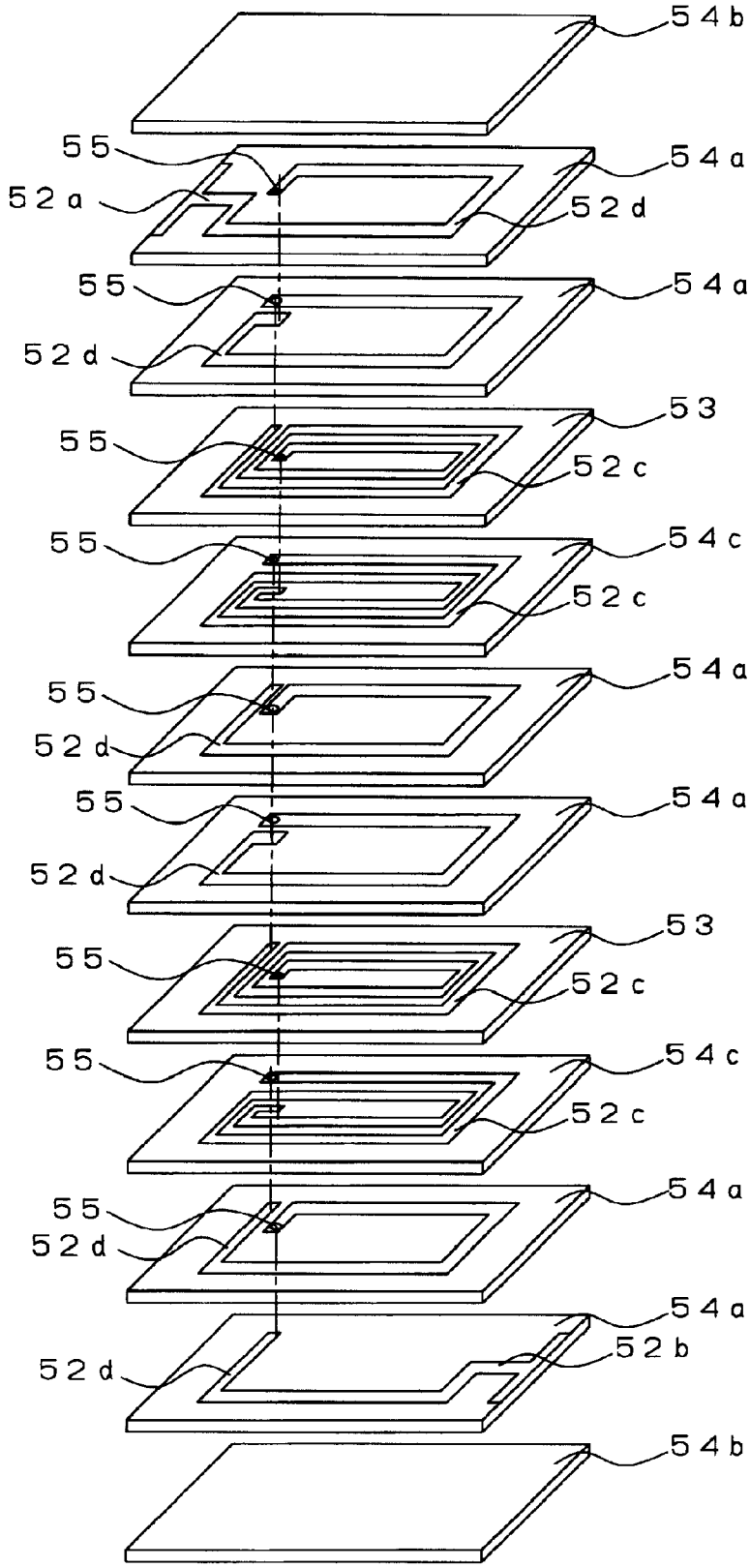
FIG. 12 is an exploded perspective view of a laminated coil according to the sixth preferred embodiment of the present invention.

FIGS. 11 and 12 illustrate a schematic cross-sectional view and an exploded perspective view, respectively, of a laminated coil according to a sixth preferred embodiment of the present invention. According to this preferred embodiment, two layers of non-magnetic body sections 53 each having conductive patterns 52*c* provided on both sides are disposed inside the laminated coil. Each of the conductive patterns 52*c* has the number of coil turns greater than that of a coil conductor 52*d* provided on a magnetic body sections 54. According to this preferred embodiment, since two layers of the non-magnetic body sections 53 are provided, twice as much as the magnetic field generated when only one layer is provided leaks to the outside of the laminated coil. Therefore, the effect of reducing magnetic saturation of the magnetic body section is increased, and the DC superimposition characteristic of the laminated coil is further improved.

The present invention is not limited to the above-described preferred embodiments, and various modifications may be used within the scope of the invention. In particular, the number of coil turns and the shape of the coil conductors according to the preferred embodiments are examples, and the number of coil turns and the shape of the coil conductors are not limited thereto.

As described above, the present invention may be used in a laminated coil, such as a choke coil, and, in particular, is advantageous in that the DC superimposition characteristic is excellent.

While preferred embodiments of the present invention have been described above, it is to be understood that variations and modifications will be apparent to those skilled in the art without departing the scope and spirit of the present invention. The scope of the present invention, therefore, is to be determined solely by the following claims.

The invention claimed is:

1. A laminated coil comprising:

a laminated body including a non-magnetic body section and magnetic body sections disposed on both main surfaces of the non-magnetic body section, each of the magnetic body sections including a plurality of stacked magnetic layers, and the non-magnetic body section including a plurality of stacked non-magnetic layers; and a coil including coil conductors provided on the magnetic body sections and the non-magnetic body section, the coil conductors being helically connected; wherein the number of coil turns of the coil conductors provided on the non-magnetic body section is greater than the number of coil turns of the coil conductors provided on each layer other than the coil conductors provided on the non-magnetic body section.

2. The laminated coil according to claim 1, wherein the coil conductors provided on the non-magnetic body section are disposed on at least one of the main surfaces of the non-magnetic body section.

3. The laminated coil according to claim 2, wherein the coil conductors provided on the non-magnetic body section are disposed on both of the main surfaces of the non-magnetic body section.

4. The laminated coil according to claim 3, wherein the coil conductors provided on the non-magnetic body section are also provided inside the non-magnetic body section.

5. The laminated coil according to claim 2, wherein the coil conductors provided on the non-magnetic body section are also provided inside the non-magnetic body section.

6. The laminated coil according to claim 1, wherein a plurality of the non-magnetic body sections is provided inside the laminated body.

7. A laminated coil comprising:

a laminated body including a non-magnetic body section and magnetic body sections disposed on both main surfaces of the non-magnetic body section, each of the magnetic body sections including a plurality of stacked magnetic layers, and the non-magnetic body section including at least one non-magnetic layer; and a coil including coil conductors provided on the magnetic body sections and the non-magnetic body section, the coil conductors being helically connected; wherein the number of coil turns of the coil conductors provided on the non-magnetic body section is greater than the number of coil turns of the coil conductors provided on the magnetic body section.

8. The laminated coil according to claim 7, wherein the non-magnetic body section includes a plurality of stacked non-magnetic layers.

9. The laminated coil according to claim 8, wherein the coil conductors provided on the non-magnetic body section are disposed on at least one of the main surfaces of the non-magnetic body section.

10. The laminated coil according to claim 8, wherein the coil conductors provided on the non-magnetic body section are disposed on both of the main surfaces of the non-magnetic body section.

11. The laminated coil according to claim 9, wherein the coil conductors provided on the non-magnetic body section are also provided inside the non-magnetic body section.

12. The laminated coil according to claim 10, wherein the coil conductors provided on the non-magnetic body section are also provided inside the non-magnetic body section.

13. The laminated coil according to claim 7, wherein a plurality of the non-magnetic body sections is provided inside the laminated body.

14. The laminated coil according to claim 7, wherein the non-magnetic body section includes a single non-magnetic layer.

15. The laminated coil according to claim 14, wherein the coil conductors provided on the non-magnetic body section are disposed on at least one of the main surfaces of the non-magnetic body section.

16. The laminated coil according to claim 14, wherein the coil conductors provided on the non-magnetic body section are disposed on both of the main surfaces of the non-magnetic body section.

17. The laminated coil according to claim 7, wherein the coil conductors provided on the non-magnetic body section are also provided inside the non-magnetic body section.

* * * * *